US008757066B2

(12) United States Patent
Heinisch et al.

(10) Patent No.: US 8,757,066 B2
(45) Date of Patent: Jun. 24, 2014

(54) DEVICE FOR PIVOTING ONE OR MORE FRONT FLAPS OF A TRACK-GUIDED VEHICLE, AND FRONT FLAP MODULE

(75) Inventors: Andreas Heinisch, Rethen (DE); Reiner Krause, Isernhagen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/702,222

(22) PCT Filed: Jun. 10, 2011

(86) PCT No.: PCT/EP2011/059694

§ 371 (c)(1),
(2), (4) Date: Jan. 31, 2013

(87) PCT Pub. No.: WO2011/154527

PCT Pub. Date: Dec. 15, 2011

(65) Prior Publication Data

US 2013/0133547 A1 May 30, 2013

(30) Foreign Application Priority Data

Jun. 10, 2010 (DE) ..... 10 2010 023 318

(51) Int. Cl.
*B61D 15/06* (2006.01)

(52) U.S. Cl.
USPC ..... 105/392.5; 105/413

(58) Field of Classification Search
USPC ..... 105/1.1, 1.3, 26.05, 238.1, 280, 392.5, 105/413
See application file for complete search history.

(56) References Cited

U.S. PATENT DOCUMENTS

| | | | | |
|---|---|---|---|---|
| 7,810,437 | B2 * | 10/2010 | Mattschull | 105/392.5 |
| 8,375,869 | B2 * | 2/2013 | Mayer | 105/392.5 |
| 2007/0186802 | A1 * | 8/2007 | Gough | 105/392.5 |
| 2010/0064931 | A1 * | 3/2010 | Heinisch et al. | 105/392.5 |
| 2011/0011302 | A1 * | 1/2011 | Mayer | 105/392.5 |
| 2011/0296762 | A1 * | 12/2011 | Ahrens | 49/340 |

(Continued)

FOREIGN PATENT DOCUMENTS

| | | | |
|---|---|---|---|
| DE | 29706073 | U1 | 7/1997 |
| EP | 0829670 | A2 | 3/1998 |

(Continued)

*Primary Examiner* — Jason C Smith
(74) *Attorney, Agent, or Firm* — Boyle Fredrickson, S.C.

(57) ABSTRACT

The invention relates to a device for pivoting one or more front flaps (1*a*, 1*b*) of a track-guided vehicle, in particular a rail vehicle. To achieve that the front flap can be opened and closed without friction and that it does not have any visible joints, the invention provides that the device comprises at least one carrier element (2) which, on the one hand, is connected with the front flap (1*a*, 1*b*) and, on the other hand, with the vehicle undercarriage, wherein the carrier element (2) can be pivoted in the horizontal plane relative to the vehicle undercarriage, and which is designed to change, during the pivoting, the front flap (1*a*, 1*b*) from a closed position into an opened position and vice versa. Furthermore, the device comprises an activation element (3) which, on the one hand, is connected with the at least one carrier element (2) and, on the other hand, with the vehicle undercarriage for pivoting the at least one carrier element (2) relative to the vehicle undercarriage. The at least one carrier element (2) comprises a shift mechanism which is designed to move the front flap (1*a*, 1*b*) especially in closed condition in longitudinal direction of the carrier element (2).

12 Claims, 6 Drawing Sheets

(56) References Cited

U.S. PATENT DOCUMENTS

Figure 1:
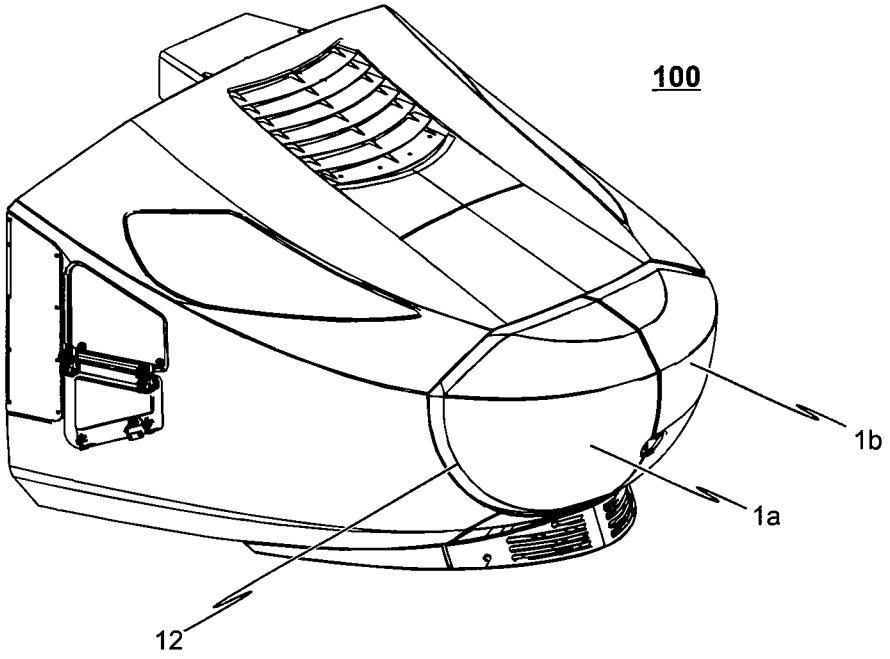

| | | | | |
|---|---|---|---|---|
| 2012/0291659 | A1* | 11/2012 | Radewagen | 105/1.3 |
| 2013/0042788 | A1* | 2/2013 | Scholz | 105/413 |
| 2013/0133547 | A1* | 5/2013 | Heinisch et al. | 105/413 |

FOREIGN PATENT DOCUMENTS

| | | | | |
|---|---|---|---|---|
| EP | 2208655 | A1 * | 7/2010 | B61D 17/06 |
| FR | 2690667 | A1 | 11/1993 | |
| WO | 2007/073273 | A1 | 6/2007 | |

* cited by examiner

DEVICE FOR PIVOTING ONE OR MORE FRONT FLAPS OF A TRACK-GUIDED VEHICLE, AND FRONT FLAP MODULE

The invention relates to a device for pivoting one or more front flaps of a track-guided vehicle, in particular a rail vehicle, and a front flap module.

In railway technology it is known to provide the front end of a vehicle with a protective housing in order to protect the coupling provided at the front end, and especially the coupling head, against weather conditions such as snow, icing, moisture and dirt when the coupling is not in use and when it is disengaged. For this purpose so-called front nose modules are used, which are mounted at the front end of the vehicle. Usually, a front nose module has at least one front flap, which can be pivoted relative to the vehicle undercarriage and the coupling provided at the front end of the vehicle, so as to be able to uncover the coupler pocket when required.

Here the term "front flap" means the enclosure of the coupler pocket which covers, when closed, the front end of the coupler pocket to protect, on the one hand, the coupling components against weather conditions and to avoid, on the other hand, that front parts have an aerodynamically disadvantageous design. This is especially important when dealing with streamlined trainsets, such as high-speed trains.

For pivoting the front flap relative to the vehicle undercarriage, it is customary to use front flap kinematics which have at least one activation element and which serve the purpose of uncovering when required the coupler pocket and thus the coupling head. In particular, this is required in order to prepare the vehicle for coupling or to allow access to the coupler pocket and the coupling components, for example, for the purpose of maintenance.

It is the objective of the invention to provide a device for pivoting a front flap by means of which the front flap can be changed from a first closed position into a second, opened position, wherein the device should be characterized by the fact that the front flap kinematics used for pivoting the front flap are designed as simple as possible but are still functioning in a reliable manner. Furthermore, the invention has the objective of designing the front flap in such a way that it can be opened and closed without friction and that it does not have any visible joints.

According to the invention, this objective is achieved by the subject matter described in the independent Claim 1.

Accordingly, the invention proposes a device for pivoting a front flap which comprises at least a carrier element which, on the one hand, is connected with the front flap and, on the other hand, with the vehicle undercarriage, and which comprises an activation element which, on the one hand, is connected with the at least one carrier element and, on the other hand, with the vehicle undercarriage. The at least one carrier element can be pivoted in the horizontal plane relative to the vehicle undercarriage, and it is designed to change, during the pivoting, the front flap from a closed position into an opened position and vice versa. The activation element has the purpose of pivoting the at least one carrier element relative to the vehicle undercarriage.

Moreover, in the invention-based solution, the carrier element comprises a shift mechanism, which is designed to move the front flap in longitudinal direction of the carrier element. In particular, it is contemplated to move the front flap in closed condition in longitudinal direction of the carrier element. However, it is also possible to use the shift mechanism in order to move the front flap in opened condition in longitudinal direction of the carrier element.

The invention-based solution comprises a multitude of advantages. On the one hand, in addition to the pivoting motion, the shift mechanism of the at least one carrier element allows the front flaps to be moved backwards (i.e., toward the vehicle undercarriage) or forward. Accordingly, it is possible to close in optically tight manner the gap between the front flap and the remaining front nose module, thus ensuring better protection for the coupling components. In addition, the shift mechanism has the purpose of effectively preventing friction between the front flap and the remaining front nose module when the front flap is opened. Thus, by means of the shift mechanism, it is possible in an advantageous manner to move the front flap in closed condition forward, i.e., away from the vehicle undercarriage, before pivoting the front flap into its opened position. In other words: prior to pivoting, the front flap is spaced from the remaining front nose module.

On the other hand, the invention-based device is characterized by its durability and low maintenance costs. In the invention-based solution, the activation element does not directly engage at the front flap but, instead, is connected with the at least one carrier element which can be pivoted in the horizontal plane relative to the vehicle undercarriage in order to change the front flap from its closed position into its opened position and vice versa. Therefore, only relatively low pressure is exerted on the bearings which are used to hinge the at least one carrier element to the front flap and to hinge the activation element to the at least one carrier element. Consequently, these bearings can have a lightweight design, resulting in weight and material reduction. In addition, the simple structure of the proposed front flap kinematics facilitates the response time of the pivoting device, because power transmission is performed directly from the activation element to the front flaps.

Furthermore, the invention-based solution is characterized by the fact that the front flap can be opened also manually by pulling at the front flap from the outside in order to move it into the correct position.

In the dependent claims advantageous developments of the invention-based solution are specified.

According to a preferred development of the invention-based device, the shift mechanism comprises one or more pneumatically, hydraulically or electrically controllable actuating cylinders, which are designed to move connecting bars in longitudinal direction of the carrier element. The actuating cylinder is connected with the front flap by means of the connecting bars. Providing such an actuating cylinder allows for faster opening processes by means of which the shift mechanism can be changed in reliable manner and synchronous with the activation element for pivoting the front flap. In advantageous manner the actuating cylinder of the shift mechanism is controlled by the same medium (compressed air, liquid, power) that is used for the activation element for pivoting the front flap. In this way, it is possible to use existing lines several times. In particular, it is advantageous to provide pneumatic actuating cylinders for the shift mechanism because the coupling area of railway vehicles frequently involves compressed air.

According to a further embodiment, the invention-based device is provided with a locking device that is connected with the vehicle undercarriage, which locking device comprises a fixation member. The fixation member can be changed from a first position, in which the carrier element is fixed relative to the vehicle undercarriage, into a second position, in which the carrier element can be pivoted in the horizontal plane relative to the vehicle undercarriage. The solution involving the fixation member is easy to implement and very effective in keeping the at least one front flap of a front flap module in the desired position (i.e., either opened or closed). Thus it can be ensured in a simple manner that even at high speeds the front flap remains in its desired position.

In view of previous embodiments, it is possible to use locking devices that have a pneumatically, hydraulically or electrically controllable actuating cylinder in order to change the fixation member from its first position to its second position. Providing such an actuating cylinder allows for fast response times, resulting in the fact that the fixation member can be changed in reliable manner and synchronous with the activation element.

It is especially preferred to provide a pneumatically controllable actuating cylinder for actuating the fixation member, because railway vehicles are usually already equipped with compressed-air lines for pneumatically controlling other components. However, it is also possible to use different switch media, for example hydraulic or electrical switch media.

On the other hand, it is also possible that the locking device comprises a spring balance which interacts with the fixation member in such a way that the fixation member is pre-tensioned in its first position. This implementation is independent of pneumatic, hydraulic of electrical switch media and is more robust compared with a pneumatically, hydraulically or electorally controllable actuating cylinder. The spring balance can comprise an inexpensive standard component which can be replaced without much effort when there is need for repair.

Furthermore, in a preferred development of the aforementioned embodiment, in which the locking device comprises a spring balance, a manually operated emergency release is provided, which can be released by means of an emergency release element for changing the fixation member from its first position to its second position. For example, if because of a malfunction it is impossible to control the locking device in order to activate the fixation member, it is possible by means of the manually operated emergency release to change the fixation member from its first position to its second position in order to open the front flap. The manually operated emergency release comprises a mechanism by means of which the front flap can be opened by hand. For example, for this purpose, it is possible to provide as emergency release element a manually operated release lever.

In a further advantageous implementation of the invention-based device, a horizontal guide is provided which interacts with the at least one carrier element. This guide is connected with the vehicle undercarriage and has the purpose of guiding the horizontal pivoting motion of the at least one carrier element relative to the vehicle undercarriage. By means of this horizontal guide, a good portion of the weight force of the front flap connected with the carrier element can be diverted directly to the vehicle undercarriage, or to a frame connected with the vehicle undercarriage. Consequently, the bearings, through which the carrier element is hinged to the front flap or to the vehicle undercarriage/frame, are unburdened and more wear-resistant.

In an advantageous development of the aforementioned embodiment, it is possible that the guide comprises at least one limit stop in order to limit the horizontal pivoting range of the carrier element. In this way, it is possible to define the pivoting range of the front flap in a way that is easy to implement and at the same time effective. As a result, it can be excluded that the front flap is opened too far, thus covering and making inaccessible important areas of the front nose, for example, a service flap provided at the front nose. When the front flap is closed, it can be ensured that the front flap is positioned at the intended location.

In an advantageous embodiment of the invention-based solution, it is provided that the at least one carrier element comprises a shock protection with at least one energy absorption element. At the same time, the at least one energy absorption element can have a destructive and/or regenerative design. By providing such a shock protection, the coupling components incorporated in the front flap module can be effectively protected against damage in the case of a crash. Here, it has to be taken into consideration that during normal usage of the vehicle the front flap and, consequently, the front nose are in a closed position. In the event of an accident, the impact energy is absorbed to a certain extent by the at least one energy absorption element. As a result, not only the coupling components, but also other body parts of the front nose, as well as the frame of the train, are protected against damage.

The at least one energy absorption element of the shock protection can have a destructive and/or regenerative design. For example, it is possible to provide a series connection of regenerative and destructive energy absorption elements. As a result, light impacts, those that can occur during shunting operations, can be absorbed by the regenerative energy absorption elements. However, when a specific impact force is exceeded, the destructive energy absorption elements absorb the impact energy at least to a certain extent, converting it into thermal energy and deformation energy.

Preferably, the invention-based solution makes provision that the at least one carrier element has a flexible design in the vertical plane relative to the front flap. Consequently, the vertical alignment of the front flap can be adjusted in specific areas. This makes it easier to assemble the front flap at the front nose or at the vehicle undercarriage. As a result, it is easier to optimize joints forming between the front flap and the remaining housing of the front nose, achieving improved tightness and aerodynamics of the front nose module.

In a preferred implementation of the invention-based solution, the at least one carrier element is hinged in pivotable manner at a bearing block in the horizontal plane. The bearing block, in turn, is attached at the vehicle undercarriage or at a frame connected with the vehicle undercarriage. Providing a bearing block facilitates the assembly of the front flap kinematics. By means of its possibly several carrier elements, it is now possible to attach in a fast and easy manner the front flap at the vehicle undercarriage/frame by means of a bearing block. It is especially possible to perform quickly and without much effort maintenance at a bearing block for several carrier elements.

Basically, it is preferred that a frame is provided that can be attached at the front end of the vehicle. By means of said frame the at least one carrier element, the activation element and the horizontal guide is connected with the vehicle undercarriage. Through the frame that can be attached at the front end of the vehicle, it is possible to attach all elements of the front nose module at a (metal) structure. As a result, it is possible to produce the entire front nose module as an overall system and to attach without much effort said system at the front end of the vehicle. This is especially advantageous when only the front nose has to be replaced, for example after a minor accident.

Furthermore, the frame can be used as additional shock protection in order to absorb impact force in the event of a crash. In this context, it is also possible to incorporate in the frame energy absorption elements already known from prior art, irrespective of whether this involves regenerative or destructive elements.

A further aspect of the invention provides a front flap module with a first front flap and a second front flap, wherein the front flap module comprises respectively for each of the front flaps a pivoting device (front flap kinematics) of the kind described above for changing the respective front flap from its closed position into an opened position and vice versa. By covering the coupler pocket at the front end of the vehicle with two front flaps that can be pivoted relative to the vehicle undercarriage, it is possible (if required) to uncover only certain areas of the front nose. Moreover, by means of the two-part embodiment, it can be accomplished that less weight force is exerted on the individual carrier elements which, in turn, protects the bearings.

In the invention-based front flap module, it is preferred that the two front flaps can be pivoted relative to one another in the horizontal plane. This provides an optimal opening of the front nose, which is especially advantageous with regard to maintenance work.

Subsequently, possible embodiments of the invention-based solution are described in more detail by means of the enclosed drawings.

Figure 2:
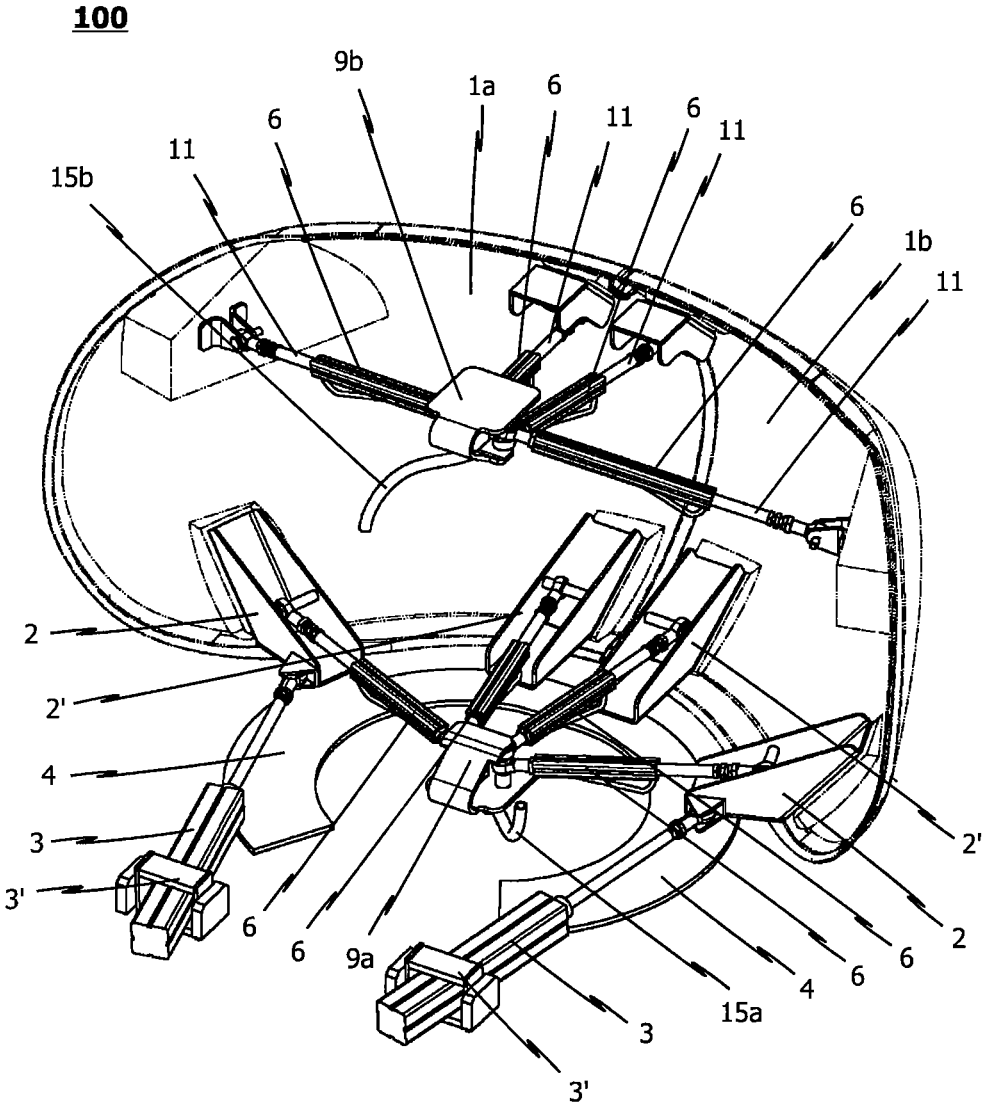
Figure 3A:
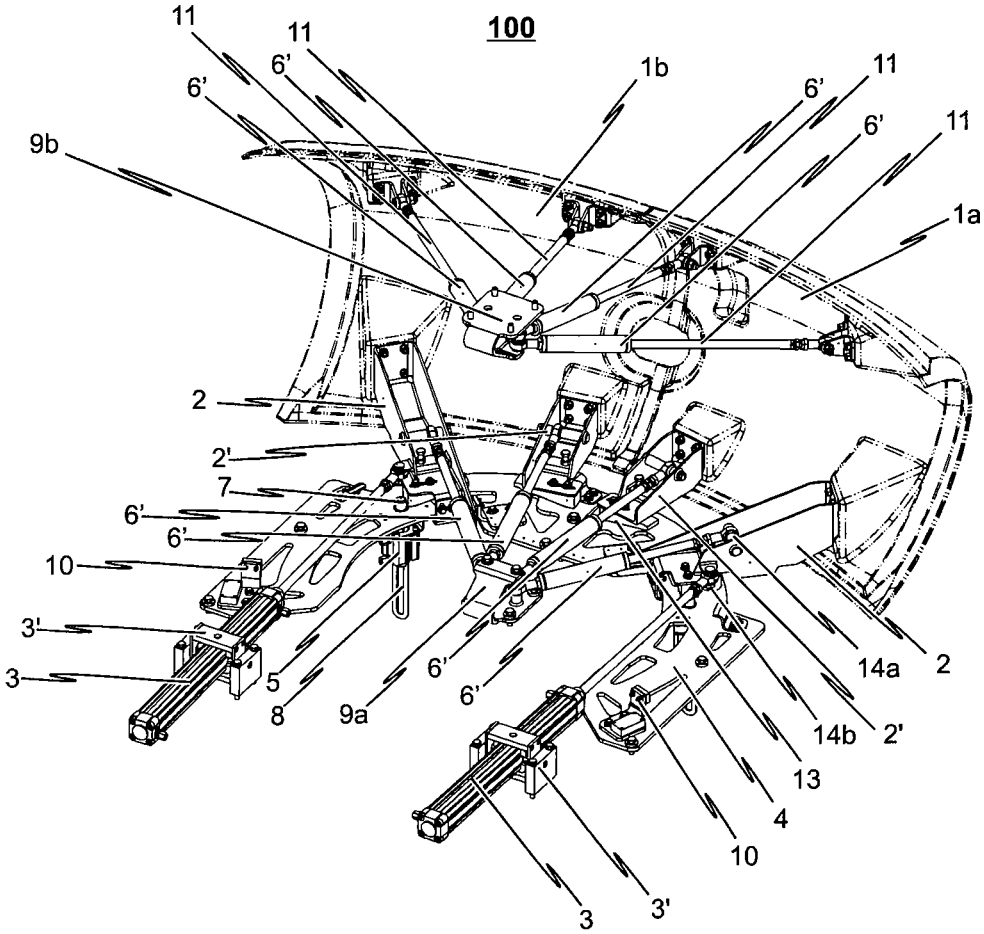
Figure 3B:
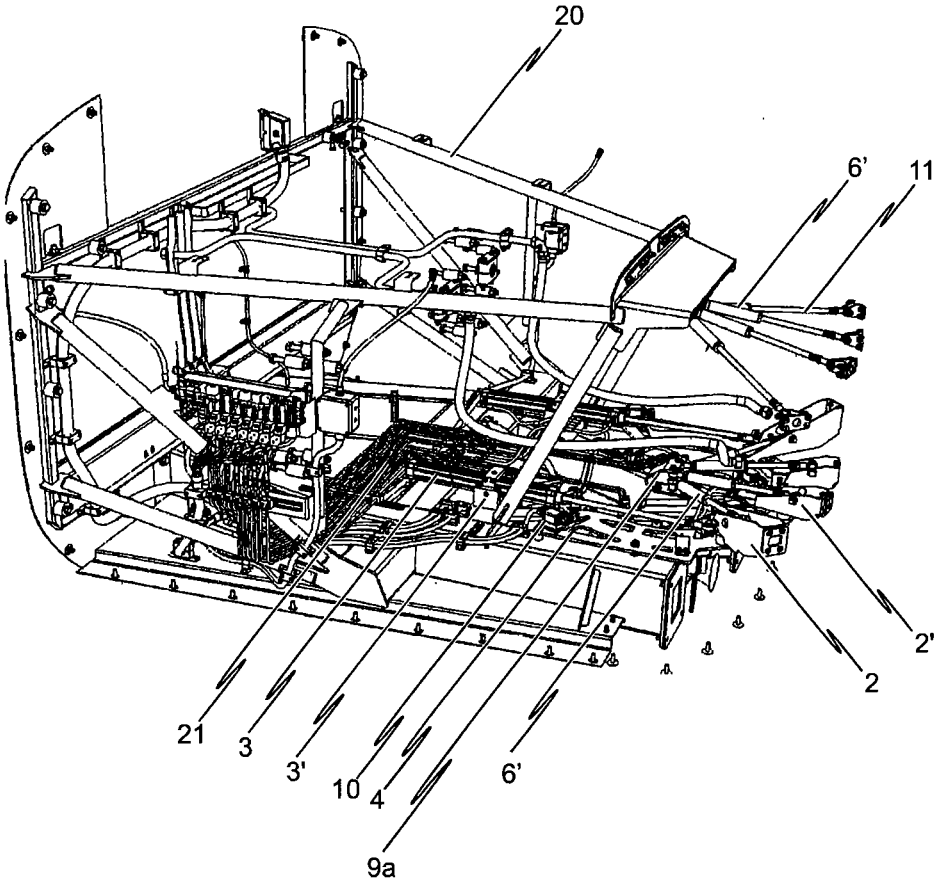
Figure 4A:
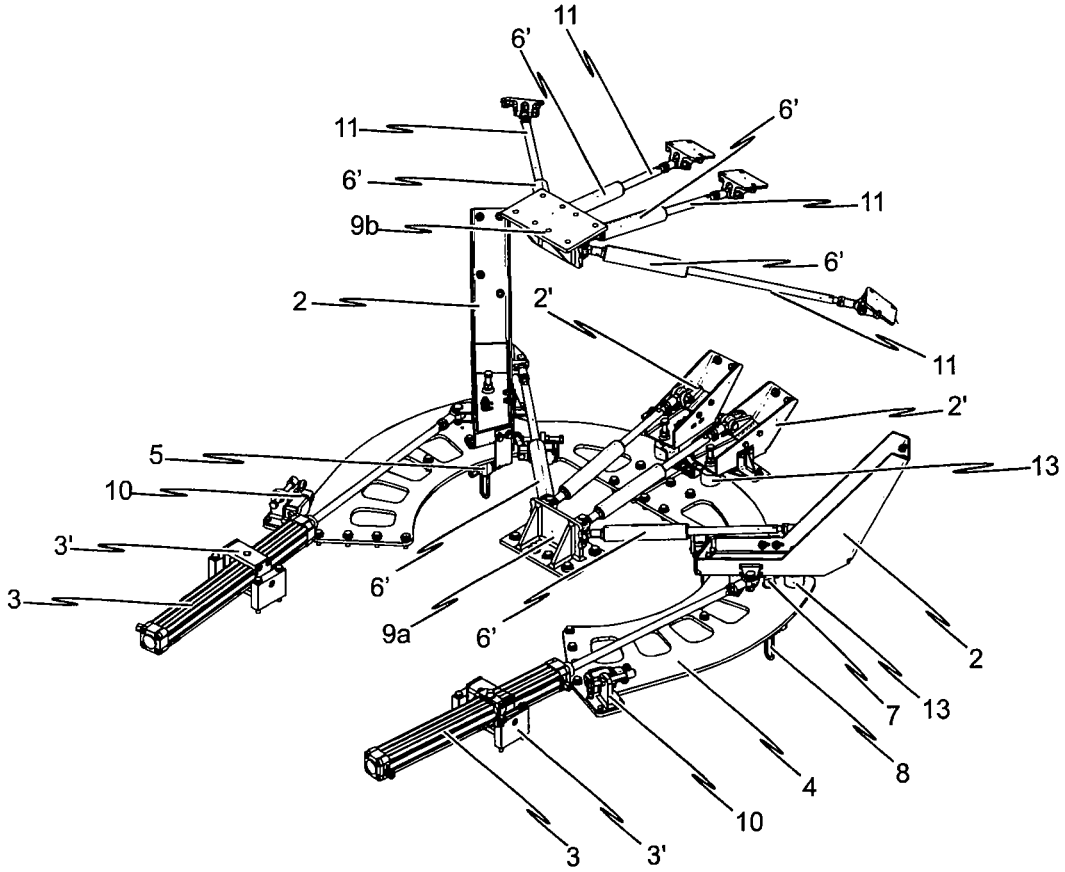
Figure 4B:
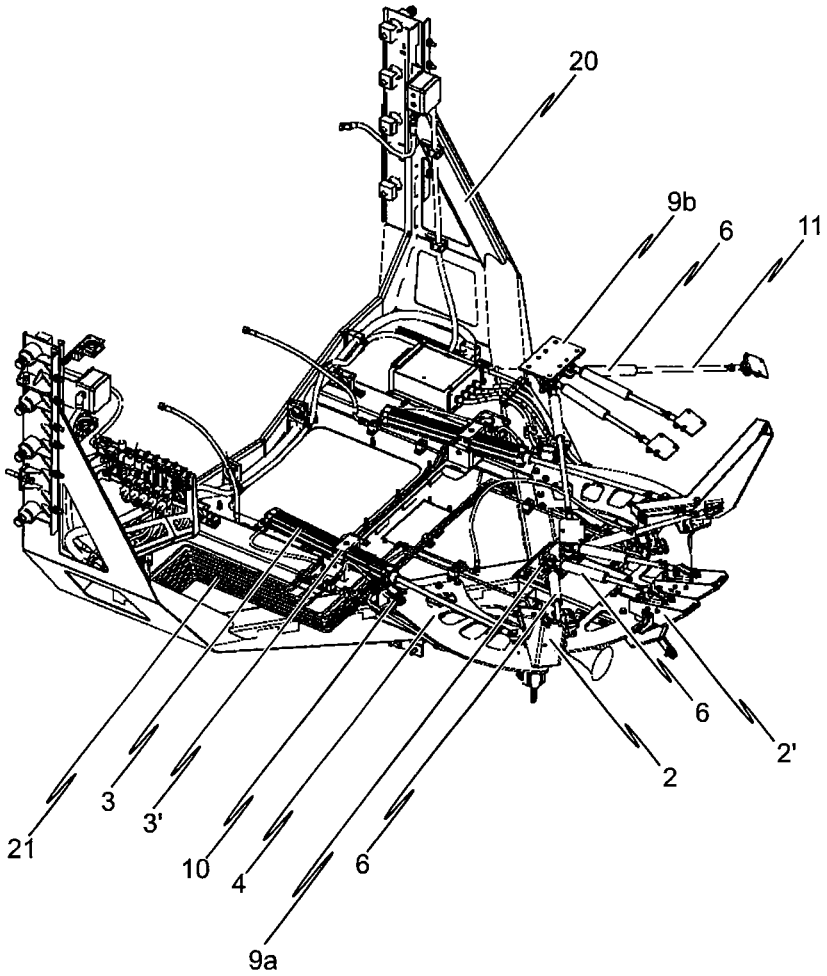

It is shown:

FIG. 1: a perspective view of a front nose of a track-guided vehicle with an exemplary embodiment of the invention-based front flap module in a closed position;

FIG. 2: a perspective view of an exemplary embodiment of the invention-based front flap module in a closed position;

FIG. 3*a*: a perspective view of an exemplary embodiment of the invention-based front flap module in a closed position;

FIG. 3*b*: a perspective view of an exemplary embodiment of the invention-based front flap according to FIG. 3*a* without front flaps, wherein the front flap kinematics are attached at a frame;

FIG. 4*a*: a perspective view of an exemplary embodiment of the invention-based device for pivoting a front flap (front flap kinematics); and FIG. 4*b*: a perspective view of an exemplary embodiment according to FIG. 4*a*, wherein the front flap kinematics are attached at a frame.

In the following detailed description of the figures, similar or similar looking parts are provided with identical reference numerals.

FIG. 1 shows a perspective view of a front nose of a track-guided vehicle with an exemplary embodiment of the invention-based front flap module 100 in closed condition. The front flap module 100 comprises a first front flap 1*a* and a second front flap 1*b*. By means of front flap kinematics (not shown in FIG. 1), the two front flaps 1*a*, 1*b* can be pivoted in the horizontal plane relative to one another. As subsequently described in more detail with reference to the views in FIGS. 1 and 2, the front flap kinematics comprise for each of the two front flaps 1*a*, 1*b* an invention-based pivoting device for pivoting the two front flaps 1*a*, 1*b*.

By providing such front flap kinematics, the two front flaps 1*a*, 1*b* can be changed from a first, closed position into a second, opened position in order to uncover a coupler pocket provided at the front end of the vehicle. In the exemplary embodiments displayed in the figures, the two front flaps 1*a*, 1*b* are pivoted in the horizontal plane to the side surfaces of the front nose module 100 in order to uncover the coupler pocket. However, it is also possible that the two front flaps 1*a*, 1*b* can be opened vertically.

Subsequently, three exemplary embodiments of the invention-based front flap module 100 are described with reference to FIG. 2, FIGS. 3*a* and 3*b*, and with reference to FIGS. 4*a* and 4*b*.

In particular, FIG. 2 shows a perspective view of a first exemplary embodiment of the invention-based front flap module 100 in closed condition.

FIG. 3*a* shows a perspective view of a second exemplary embodiment of the invention-based front flap module 100 in closed condition. FIG. 3*b*, on the other hand, shows a perspective view of the exemplary embodiment of the invention-based front flap module 100 according to FIG. 3*a* without front flaps, wherein the front-flap kinematics are attached at a frame 20.

FIG. 4*a* shows a perspective view of a further exemplary embodiment of the invention-based device for pivoting a front flap (front flap kinematics). FIG. 4*b*, on the other hand, shows a perspective view of the exemplary embodiment according to FIG. 3*a*, wherein the front flap kinematics are attached at a frame 20.

The front flap module 100 shown in FIGS. 2, 3*a* and 4*a* comprises a first front flap 1*a* and a second front flap 1*b*, wherein each of the two front flaps 1*a*, 1*b* can be pivoted relative to one another by means of a pivoting device in the horizontal plane. The two pivoting devices attached to the front flaps 1*a*, 1*b* establish the front flap kinematics for pivoting the two front flaps 1*a*, 1*b*.

Subsequently, the structure and functionality of the front flap kinematics for pivoting the two front flaps 1*a*, 1*b* are described with reference to FIGS. 2, 3*a*, 3*b* and 4*a*, 4*b*.

As shown in FIG. 2, 3*a* or FIG. 4, each pivoting device comprises a total of two carrier elements 2, 2' which, on the one hand, are connected with the respective front flap 1*a*, 1*b* and, on the other hand, with the vehicle undercarriage or frame (not shown in FIGS. 2, 3*a* and FIG. 4*a*). In the embodiment shown in FIG. 2, FIG. 3*a* and FIG. 4*a*, the carrier elements 2, 2' are connected with the vehicle undercarriage or frame by means of a bearing block 9*a* used for all carrier elements 2, 2'.

According to the embodiment shown in FIG. 3*b* or FIG. 4*b*, the bearing block 9*a* is connected with a frame 20 (not shown in FIG. 3*a* and FIG. 4*a*). Preferably, the frame 20 is releasably connected with the front end of the vehicle and the vehicle undercarriage. The same applies to the embodiment shown in FIG. 2.

As indicated in the embodiments shown in FIG. 2, FIG. 3*a* and FIG. 4*a*, an activation element 3 is attached to one of the carrier elements 2, 2' of each front flap 1*a*, 1*b*, and in particular at the outer carrier element identified with the reference numeral "2". On the other hand, the activation element 3 is connected with the frame 20 by means of a cardanic clamping bar 3' and has the purpose of pivoting the respective carrier element 2.

In the embodiments shown, the activation elements 3 are designed in the form of piston cylinders, which are hinged at the vehicle undercarriage or frame 20 by means of the cardanic clamping bar 3' and which can be pivoted in the horizontal plane. The opposite end region of the piston cylinder is hinged at the corresponding carrier element 2. When, based on the fact that the front flaps shown in the figures are in a closed position, the activation element 3 is activated, the carrier elements 2 are pivoted in the horizontal plane through the traction force of the activation elements 3. As a result, the front flaps 1*a*, 1*b* attached to the respective carrier elements 2, 2' are opened. The closing process takes place analogous by means of the compressive force of the piston cylinder.

In the embodiment shown in FIG. 2, the carrier elements 2, 2' comprise also a shift mechanism which is designed to move the front flaps 1*a*, 1*b* in longitudinal direction of the carrier elements 2, 2'. In particular, it is contemplated to move the front flaps in longitudinal direction of the carrier elements 2, 2' when they are closed, as shown in FIG. 2. However, it is also possible to use the shift mechanism for moving the front flap in its opened condition in longitudinal direction of the carrier elements 2, 2'. Consequently, by means of the shift mechanism of the at least one carrier element 2, 2', the front flaps 1*a*, 1*b* can be moved backward (i.e., toward the vehicle undercarriage) or forward, in addition to the pivoting motion. Accordingly, the horizontal joints 12 shown in FIG. 1, which are formed between the front flaps 1*a*, 1*b* and the remaining housing of the front nose, can be optimally closed, thus improving the sealing of the front nose module 100.

Furthermore, the shift mechanism has the purpose of effectively preventing friction between the front flaps 1*a*, 1*b* and the remaining front nose module during the process of opening the front flaps 1*a*, 1*b*. By means of the shift mechanism, it is thus possible to move in an advantageous manner the front flaps 1*a*, 1*b* in a closed position forward, i.e., away from the vehicle undercarriage, before the front flaps 1*a*, 1*b* are pivoted into their opened position. As a result, the front flaps are spaced from the remaining front nose module prior to the pivoting process.

FIG. 2 also indicates that the shift mechanism comprises in particular several pneumatically, hydraulically and electrically controllable actuating cylinders 6, which are designed to move connecting bars 11 in longitudinal direction of the carrier elements 2, 2'. The actuating cylinders 6 are connected with the front flap 1*a*, 1*b* by means of the connecting bars 11. Preferably, the actuating cylinders 6 of the shift mechanism are controlled by the same medium (compressed air, liquid, power) that is used for the activation elements 3 for pivoting the front flap. In particular, this means that preferably the actuating cylinders 6 are designed as pneumatic actuating cylinders 6 which are supplied with compressed air by means of the supply lines 15*a* and 15*b* shown in FIG. 2.

At this point, it is appropriate to mention that in the embodiment shown in FIG. 2 an upper bearing block 9*b* is provided in addition to the (lower) bearing block 9*a*, which upper bearing block is attached at the frame (not shown). Said upper bearing block 9*b* has to purpose of hinging upper connecting bars 11 which are controlled also by means of the above-mentioned actuating cylinders 6 and, consequently, can be moved.

Furthermore, in the embodiments shown in FIGS. 3*a*, 3*b* and 4*a*, 4*b*, a locking device 5 is provided, which has the purpose of fixing the carrier elements 2, 2' relative to the vehicle undercarriage of frame 20 when the front flap 1*a*, 1*b* is opened or closed. For this purpose, the locking device 5 comprises an extendable and a retractable fixation member 7 which is designed as a pin in the embodiment shown. The fixation member 7 can be moved into a first, extended position (see FIG. 3*a*) in which the carrier elements 2, 2' are kept in their position, or it can be moved into a second, counter-sunk position in which the carrier elements 2, 2' can be pivoted in the horizontal plane relative to the vehicle undercarriage or frame 20. In particular, it is advantageous when the fixation member 7 is designed as a retractable pin.

In an advantageous manner, the locking devices 5 are attached below a guide 4 which will be subsequently described in more detail. Accordingly, the fixation member 7 designed as a pin is moved vertically through a bore hole in the horizontal guide 4.

As mentioned above, the fixation members 7 have to be changed from a first into a second position before the carrier elements 2 can be pivoted from an end position into the next position. For this purpose, the locking device 5 comprises a pneumatically, hydraulically or electrically controllable actuating cylinder which moves the fixation member 7 between the above-mentioned positions. At the same time, it is possible to operate the actuating cylinder by means of media already used in rail traffic, for example, compressed air or power which, in turn, saves the expenses for installation and operation.

In the event that compressed air or power are not available, it is preferred when the fixation member 7 remains in its first, extended position in which the carrier elements 2, 2' are fixed in their position. For this purpose, the fixation member 7 can be pre-tensioned in its first position by means of a spring balance.

In the context of the above-mentioned spring balance pretension, it is also possible to provide a manual emergency release mechanism for the fixation member 7. If the automatic control of the fixation member 7 fails, the fixation member can be changed by means of an emergency release element 8 from its first, extended position to its second, retracted position. For example, this could be utilized in order to open the front flap 1 manually for the purpose of maintenance. Preferably, a lever is used for this purpose in order to open the emergency release element 8 designed as a loop.

As shown in FIGS. 3*a* and 4*a*, the carrier elements 2, 2' are guided by means of tapered sliding components 13 on an above-mentioned horizontal guide 4. The horizontal guide 4 is, or can be, also connected with the vehicle undercarriage or frame 20 and has the purpose of guiding the carrier elements 2, 2' in their horizontal pivoting motion. By means of the horizontal guide of the carrier elements 2, 2', a good portion of the weight force of the respective front flap 1*a*, 1*b* connected with the carrier elements 2, 2' is diverted directly to the vehicle undercarriage or frame 20. Accordingly, the bearings 14*a*, 14*b* of the carrier elements 2, 2' are unburdened, resulting in longer service life.

In addition, the horizontal guide 4 comprises several limit stops 10 for limiting the horizontal pivoting range of the carrier elements 2, 2'. In other words, the limit stops 10 determine the maximum pivoting range of the carrier elements 2.2' and thus prevent excessive pivoting of the front flaps 1*a*, 1*b*. At the same time, it is of advantage to attach the limit stops 10 at least at a first position which defines the maximum opening condition and at a second position which prevents the front flaps from colliding during the process of closing.

In the two embodiments according to FIGS. 3*a*, 3*b* and 4*a*, 4*b* of the invention-based device, the carrier elements 2, 2' are equipped in an advantageous manner with energy absorption elements 6'. Said elements are used to absorb and change the energy of slight impacts from the direction of the front flap 1, for example, impacts resulting from shunting operations. In the event of destructive energy absorption elements 6', it is possible to absorb high speed impacts at least to a certain extent. This occurs when impact energy is converted into thermal energy and deformation energy.

Alternatively, it is also possible to design the energy absorption element 6' in regenerative manner, for example, in the form of a spring balance. Particularly during shunting operations, it is thus possible to absorb slight impacts, in order to protect the body of the front nose against damages. It is also possible to provide for this purpose a combination of regenerative and destructive energy absorption elements 6', either connected in parallel or connected in series.

Also with regard to the embodiments according to FIGS. 3*a*, 3*b* and 4*a*, 4*b*, it should be noted that it is also possible to equip the carrier elements 2, 2' with actuating cylinders 6, such as have been described with reference to the embodiment shown in FIG. 2. Furthermore, it is possible to implement a combination of both embodiments. It is also possible to provide actuating cylinders 6 with integrated energy absorption elements 6'.

FIGS. 3*a* and 4*a* show that the carrier elements 2, 2' are hinged in pivotable manner relative to the respective front flap 1*a*, 1*b* in the vertical plane. The vertical alignment of the front flaps 1*a*, 1*b* relative to the vehicle undercarriage or frame 20 can be adjusted in specific areas. This makes it easier to assemble the front flaps 1*a*, 1*b* at the front flap kinematics. Furthermore, with reference to the depiction in FIG. 1, it is possible to optimize horizontal joints 12, which form between the front flaps 1*a*, 1*b* and the remaining housing of the front nose, thus achieving improved tightness and aerodynamics of the front nose module 100.

As mentioned previously, the carrier elements 2, 2' can be pivoted in the horizontal plane at the mutual bearing block 9*a*. The bearing block 9*a* is connected with the vehicle undercarriage or frame 20. In the embodiments shown in FIGS. 3*a*, 3*b* and 4*a*, 4*b*, an upper bearing block 9*b* is provided in addition to the (lower) bearing block 9*a*, with the upper bearing block attached at the frame 20. Said upper bearing block 9*b* has the purpose of hinging the connecting bars 11 in which the energy absorption energy 6' is integrated. On the other hand, the connecting bars 11 are hinged in the upper area of the respective front flap 1*a*, 1*b* and can assume a certain support function.

FIGS. 3*b* and 4*b* show the aforementioned frame 20 by means of which the carrier elements 2, 2', the horizontal guide 4 and the activation elements 3 are connected with the vehicle undercarriage. As shown, the bearing blocks 9*a*, 9*b* represent a connecting link between the carrier elements 2, 2' and the frame 20. The pneumatic and electrical supply lines 21 for the front flap kinematics are also integrated in the frame 20. The frame 20 is connected with all components of the pivoting device. Therefore, it is possible to produce the entire front nose module as an overall system. Consequently, after an accident, the entire front nose module can be replaced without much effort.

Furthermore, the frame 20 can be used as an additional energy absorption element in order to absorb additional impact energy in the event of an impact. At the same time, it is possible to incorporate in the frame 20 energy absorption elements already known from prior art.

As indicated in FIG. 3*b* and FIG. 4*b*, the rear end of the frame 20 can be connected in detachable manner with the vehicle undercarriage.

The invention is not restricted to the embodiment described with reference to the drawings but is the product of an overview of all characteristics described herein.

REFERENCE LIST

1*a*, 1*b* front flap
2, 2' carrier element
3 activation element
3' cardanic clamping bar
4 horizontal guide
5 locking device
6 actuating cylinder
6' energy absorption element
7 fixation member
8 emergency release element
9*a*, 9*b* bearing block
10 limit stop
11 connecting bars
12 horizontal joint
13 sliding component
14*a*, 14*b* bearing
15*a*, 15*b* supply line
20 frame
21 supply lines
100 front flap module

The invention claimed is:

1. A device for pivoting one or more front flaps of a track-guided vehicle, in particular a rail vehicle, the device comprising;

at least one carrier element connected to the one or more front flaps and to a vehicle undercarriage of a track guided vehicle, the at least one carrier element can be pivoted in the horizontal plane relative to the vehicle undercarriage, for moving the one or more front flaps from a closed position into an opened position and vice versa; and an activation element connected to the at least one carrier element and to the vehicle undercarriage for pivoting the at least one carrier element relative to the vehicle undercarriage;

wherein the at least one carrier element includes a shift mechanism which is designed to move the one or more front flaps in the closed condition in the longitudinal direction of the at least one carrier element, and wherein the at least one carrier element is arranged on a guide which is connected to the vehicle undercarriage, and which can be pivoted in the horizontal plane so the at least one carrier element is guided in its horizontal pivoting motion and a portion of the weight force of the one or more front flaps connected to the at least one carrier element is diverted directly to the vehicle undercarriage.

2. The device according to claim 1, wherein the shift mechanism includes one or more pneumatically, hydraulically or electrically controllable actuating cylinders and is designed to move the connecting bars in a longitudinal direction of the at least one carrier element, and wherein the actuating cylinders are connected to the one or more front flaps by the connecting bars.

3. The device according to claim 1, further comprising a locking device with a fixation member connected to the vehicle undercarriage, wherein the fixation member can be moved from a first position, in which the at least one carrier element is fixed relative to the vehicle undercarriage, into a second position in which the at least one carrier element can be pivoted in the horizontal plane relative to the vehicle undercarriage.

4. The device according to claim 3, wherein the locking device includes pneumatically, hydraulically or electrically controllable actuating cylinders for changing the fixation member from the first position into the second position.

5. The device according to claim 3, wherein the locking device includes a spring balance which interacts with the fixation member in such a way that the fixation member is pre-tensioned in the first position.

6. The device according to claim 5, wherein the locking device includes a manually operated emergency release which can be released by an emergency release element for changing the fixation member from the first position to the second position.

7. The device according to claim 1, wherein the guide includes at least one limit stop for limiting the horizontal pivoting range of the carrier element.

8. The device according to claim 1, wherein the at least one carrier element includes a shock protection with at least one energy absorption element.

9. The device according to claim 8, wherein the at least one energy absorption element has one of a destructive design and a regenerative design.

10. The device according to claim 1, wherein the at least one carrier element is arranged in the vertical plane such that the at least one carrier can be pivoted relative to the one or more front flaps.

11. The device according to claim 1, further comprising a bearing block connected to the vehicle undercarriage, wherein the at least one carrier element is hinged in the horizontal plane in a pivotable manner to the bearing block.

12. The device according to claim 1, further comprising a frame mounted to a front end of the vehicle, wherein the carrier element, the activation element and the horizontal guide are connected with the vehicle undercarriage by the frame.

* * * * *